US005866857A

United States Patent [19]

Tseng

[11] Patent Number: 5,866,857

[45] Date of Patent: Feb. 2, 1999

[54] STRUCTURE OF MODEM SHELL WITH ROUND SOUND SUPPRESSION

[75] Inventor: Scott Tseng, Taipei, Taiwan

[73] Assignee: Taicom Data Systems Co., Ltd., Taipei Hsien, Taiwan

[21] Appl. No.: 988,965

[22] Filed: Dec. 11, 1997

[51] Int. Cl.[6] ..... G10K 11/00

[52] U.S. Cl. ..... 181/141; D14/242

[58] Field of Search ..... 181/141, 150, 181/175; 379/428, 440; D14/242

[56] References Cited

U.S. PATENT DOCUMENTS

D. 350,741 9/1994 Chen ..... D14/242

D. 384,672 10/1997 Heberling ..... D14/242

D. 395,434 6/1998 Fincher, Jr. ..... D14/242

*Primary Examiner*—Khanh Dang

*Attorney, Agent, or Firm*—Varndell Legal Group

[57] ABSTRACT

A structure of modem shell with round sound suppression comprises: a box formed by opposite upper and lower half shell bodies, wherein a concave spacing the opening of which is directed outwards is installed thereon, while within the spacing is installed with a line output hole; a covering plate the size of which is enough to cover the opening of the spacing, and a plurality of through holes is installed on the covering surface thereof; and a buckling mechanism is formed by at least two pairs of buckling holes and a pillar; thereby, the spacing is used to locate a trumpet and then is covered by a covering plate so to effectively suppress the round sound generated by the modem.

3 Claims, 4 Drawing Sheets

STRUCTURE OF MODEM SHELL WITH ROUND SOUND SUPPRESSION

BACKGROUND OF THE INVENTION

1. Field of the invention

The present invention is related to an improvement of the modem shell, especially to a novel modem shell structure within which the trumpet and the box is isolated so to effectively suppress the generated round sound.

2. Description of the prior art

The prior modem has a low transmission rate and performs only one function for transmitting information. But since the technology is progressive, the data transmission rate has been improved greatly and a multi-function product is more and more popular, for example, it is also used as a recorder or a facsimile, even during data transmission, the sound and image may transmit simultaneously, thus it is a needed tool in the information network. However, although the new type modem has a high speed and superior functions, the structure of the modem shell has no improvement for a long time, thus this has dramatically affected the communication of sound. In usage, it is easy to generate a round sound within the box as a record player. A prior modem shell is shown in FIG. 1, in assembling, in the inner part thereof has only a circular flange for locating trumpet. In design, only basic location and fixedness effects are existed, but the sound effect within the shell has not programmed effectively and the back of the trumpet faces to the enclosed shell body, thus during talking, the sound will round within the shell body, therefore, it has an ill effect and is not matched with the compact high transmission rate and other practical functions. Accordingly, it is needed to improve the structure thereof.

Accordingly, since the prior modem shell has some defects described hereinabove, the inventor of the present invention has made a great effort to improve the prior structure and finally, the present invention is invented.

SUMMARY OF THE INVENTION

The main object of present invention is to provide a structure of modem shell within which the round sound is suppressed effectively.

The second object of the present invention is to provide another sound isolation layer to said modem shell so to promote the effect of suppression round sound.

In order to achieve said effects, the structure of modem shell with round sound suppression of the present invention comprises: a box formed by opposite upper and lower half shell bodies, wherein a concave spacing the opening of which is directed outwards is installed thereon, while within the spacing is installed with a line output hole; a covering plate the size of which is enough to cover the opening of the spacing, and a plurality of through holes is installed on the covering surface thereof; and a buckling means being formed by at least two pairs of buckling holes and a pillar; thereby, the spacing is used to locate a trumpet and then is covered by a covering plate so to effectively suppress the round sound generated by the modem. Thus the sound quality of the present invention is superior than that in the prior art.

The present invention will be better understood and its numerous objects and advantages will become apparent to those skilled in the art by referencing to the following drawings in which:

DETAILED DESCRIPTION OF THE PREFERRED EMBODIMENT

Figure 1:
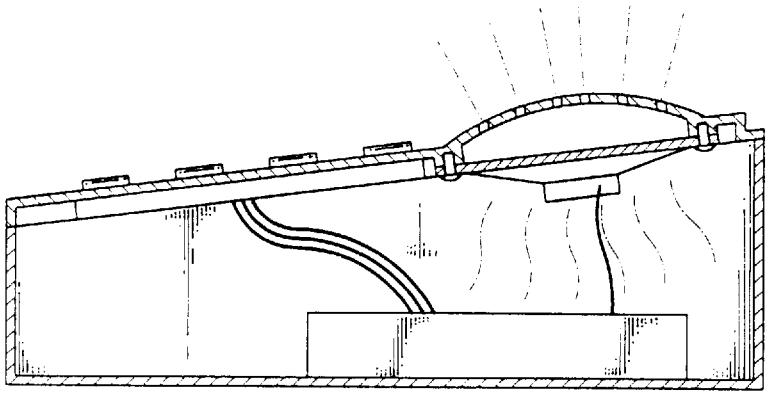
FIG. 1 PRIOR ART
FIG. 1 is a plane view of the prior modem shell structure locating a trumpet.
Figure 2:
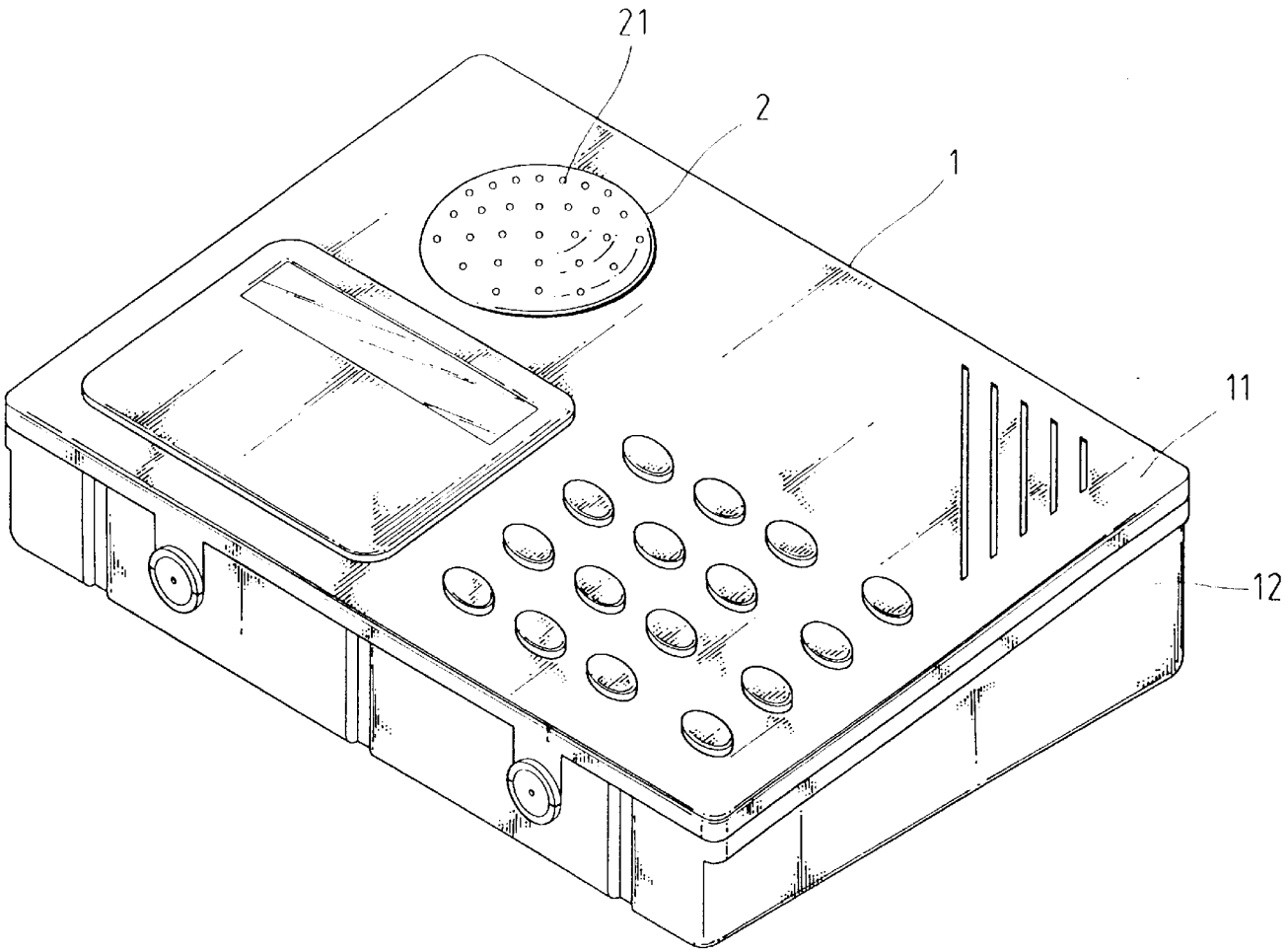
FIG. 2 is a perspective view of the embodiment of the present invention.
Figure 3:
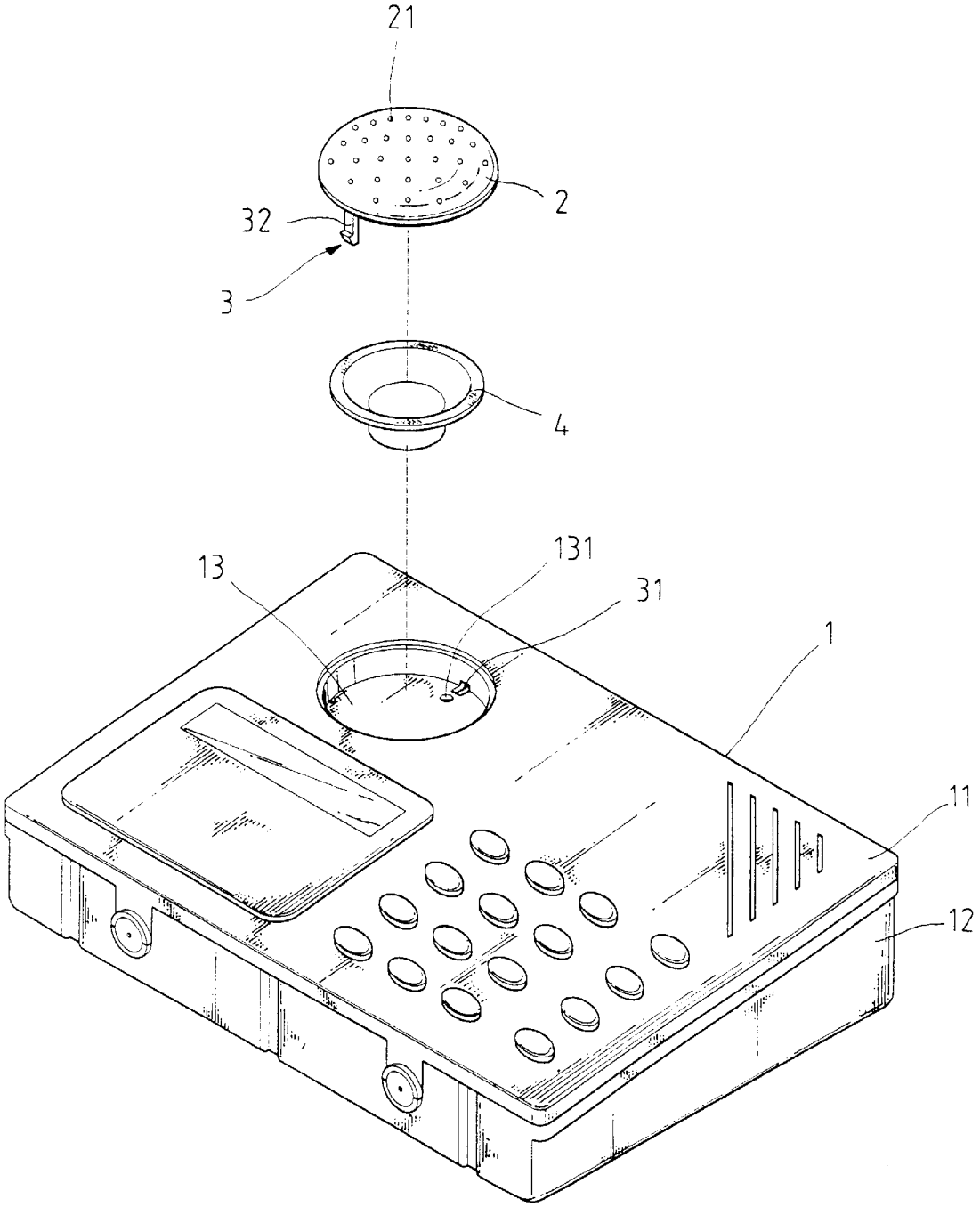
FIG. 3 is a partly exploded view of the present invention.

Now referring to FIGS. 2, and 3, the structure of modem shell with round sound suppression mainly comprising: a box 1 with concave spacing 13, a cover plate 2 with a cover spacing 13 and a buckling means 3 tightly engaged with the covering plate 2 and the spacing 13, wherein:

the box 1 is formed by the opposite upper and lower shell body 12 and 13, wherein a concave spacing 13 the opening of which is directed outwards is installed on the surface of the upper shell 11, and the spacing 13 has a round concave shape, while a stepped lip shape is installed on the opening, while within the spacing is installed with a line output hole 131 for line output by a trumpet.

Figure 4:
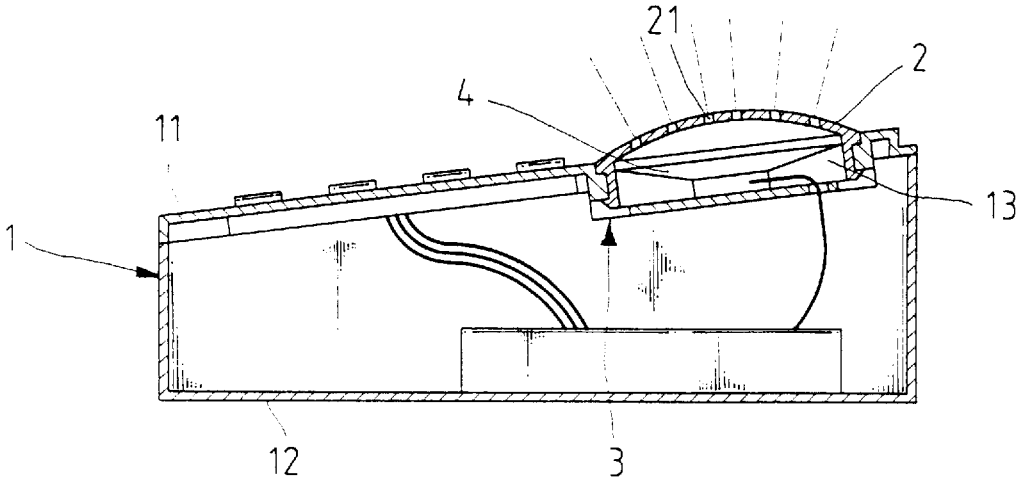
FIG. 4 is an assembled plan view of the present invention.
Figure 5:
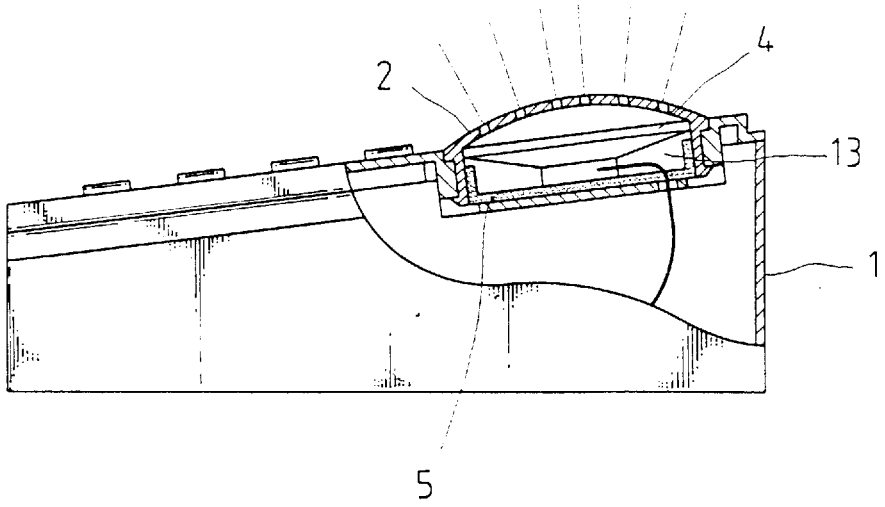
FIG. 5 is a plane view of the present invention, wherein the concave spacing is further installed with a sound isolation layer.

A covering plate 2 is a round convex piece the size of which is enough to cover the opening of the spacing 13, and a plurality of through holes 21 are installed on the covering surface thereof for propagating the sound of the trumpet, and;

A buckling means is formed by at least two pairs of buckling holes 31 and a pillar 32, wherein two buckling holes 31 are installed on the rim portion of the bottom plate 1 of the spacing 31, while the pillar 32 is vertically installed below the two sides of the covering plate 2;

Thereby, as shown in FIGS. 3 and 4, in assembling, the trumpet 4 may be located into the spacing 13 and the connecting line thereof is extended outwards from the line output hole 131 to connect with the circuit board of the modem and then it is covered by a covering plate 2 to fixedly buckle with the buckling means 3 so that after the modem is assembled, the portion of the trumpet 4 may be independently isolated, thus the sound will not round with the modem, thus the aforementioned design may obtain preferred sound quality. As shown in FIG. 5, a blowing layer 5 may be appended inside the spacing 13 for enforcing the sound isolation effect so that after the trumpet has been located insides, in addition to the original spacing, the blowing layer 5 may used to absorb sound to attain the double effects of sound absorption.

In summary, the structure of modem shell of the present invention is not only a novel design but also a practical product, and in effect it has the effect of suppressing round sound, thus high quality communication requirement is attained.

Although certain preferred embodiment of the present invention has been shown and described in detail, it should be understood that various changes and modification may be made therein without departing from the scope of the appended claims.

What is claimed is:

1. A structure of modem shell with round sound suppression comprising:

a box formed by opposite upper and lower half shell bodies, wherein a concave spacing the opening of which is directed outwards is installed thereon, while within the spacing is installed with a line output hole;

a covering plate the size of which is enough to cover the opening of the spacing, and a plurality of through holes being installed on the covering surface thereof; and a buckling means being formed by at least two pairs of buckling holes and a pillar; thereby, the spacing is used to locate a trumpet and then is covered by a covering plate so to effectively suppress the round sound generated within the modem shell.

2. The structure of modem shell with round sound suppression as claimed in claim 1, wherein the spacing is located on the surface of the upper half shell body.

3. The structure of modem shell with round sound suppression as claimed in claim 1, wherein within the spacing is installed with a blowing layer for enforcing the effect of sound isolation.

* * * * *